US009732645B2

(12) United States Patent
Colette

(10) Patent No.: US 9,732,645 B2
(45) Date of Patent: Aug. 15, 2017

(54) IC POWER PLANT AND METHOD OF OPERATION

(71) Applicant: Anthony Colette, Milton, GA (US)

(72) Inventor: Anthony Colette, Milton, GA (US)

(73) Assignee: Tony S. Colette, Milton, GA (US)

( * ) Notice: Subject to any disclaimer, the term of this patent is extended or adjusted under 35 U.S.C. 154(b) by 278 days.

(21) Appl. No.: 14/699,903

(22) Filed: Apr. 29, 2015

(65) Prior Publication Data

US 2015/0247433 A1 Sep. 3, 2015

Related U.S. Application Data

(63) Continuation-in-part of application No. 13/459,849, filed on Apr. 30, 2012, now abandoned.

(51) Int. Cl.

| | |
|---|---|
| ***F01N 1/02*** | (2006.01) |
| ***F01N 13/04*** | (2010.01) |
| ***F01N 13/02*** | (2010.01) |
| ***F01N 1/00*** | (2006.01) |
| ***F01N 1/16*** | (2006.01) |
| ***F01N 13/10*** | (2010.01) |

(52) U.S. Cl.

CPC ..... *F01N 1/023* (2013.01); *F01N 1/003* (2013.01); *F01N 1/16* (2013.01); *F01N 1/161* (2013.01); *F01N 13/02* (2013.01); *F01N 13/04* (2013.01); *F01N 13/107* (2013.01)

(58) Field of Classification Search

CPC . F02B 27/04; F01N 1/02; F01N 1/166; F01N 1/165; F01N 13/08; F01N 13/082; F01N 2490/20; F01N 2470/24; H04F 1/025; H04R 1/028; H04R 2499/013; H04R 1/021

See application file for complete search history.

(56) References Cited

U.S. PATENT DOCUMENTS

| | | | | | |
|---|---|---|---|---|---|
| 3,525,419 | A * | 8/1970 | Cassel | F01N 1/02 | 181/212 |
| 4,522,029 | A * | 6/1985 | Tomita | F02B 27/06 | 60/312 |
| 4,545,200 | A * | 10/1985 | Oike | F01N 1/166 | 180/219 |
| 4,546,733 | A * | 10/1985 | Fukami | F01N 1/006 | 123/184.57 |
| 4,558,566 | A * | 12/1985 | Shirakura | F01N 1/02 | 60/312 |
| 5,261,231 | A * | 11/1993 | Huh | F02B 21/00 | 123/184.53 |
| 5,333,576 | A * | 8/1994 | Verkleeren | B60K 13/02 | 123/184.53 |
| 5,723,829 | A * | 3/1998 | Inomata | F01N 1/165 | 181/254 |
| 2002/0043065 | A1* | 4/2002 | Ban | F02G 5/02 | 60/320 |

(Continued)

FOREIGN PATENT DOCUMENTS

| | | | | |
|---|---|---|---|---|
| DE | EP 0481450 A1 * | 4/1992 | ..... | F01N 1/023 |
| DE | 4316778 A1 * | 11/1994 | ..... | F01N 3/30 |

(Continued)

*Primary Examiner* — Patrick Maines

(57) ABSTRACT

An internal combustion (IC) power plant includes an IC engine and an exhaust system carrying exhaust gasses from the IC engine to an outlet communicating to the atmosphere.

13 Claims, 6 Drawing Sheets

(56) References Cited

U.S. PATENT DOCUMENTS

| | | | | |
|---|---|---|---|---|
| 2005/0199439 | A1* | 9/2005 | Goenka | F02M 35/1261<br>181/250 |
| 2006/0000667 | A1* | 1/2006 | Osterkamp | F01N 1/02<br>181/249 |
| 2008/0093162 | A1* | 4/2008 | Marocco | F01N 1/023<br>181/250 |
| 2009/0272601 | A1* | 11/2009 | Hagiwara | F01N 1/04<br>181/249 |
| 2013/0291816 | A1* | 11/2013 | Serrano | F01L 1/344<br>123/90.17 |

FOREIGN PATENT DOCUMENTS

| | | | | |
|---|---|---|---|---|
| FR | 2959566 | A1 * | 11/2011 | F01N 1/023 |
| JP | EP 1939415 | A1 * | 7/2008 | F01N 1/003 |
| WO | WO 2016040543 | A1 * | 3/2016 | F01N 1/023 |

* cited by examiner

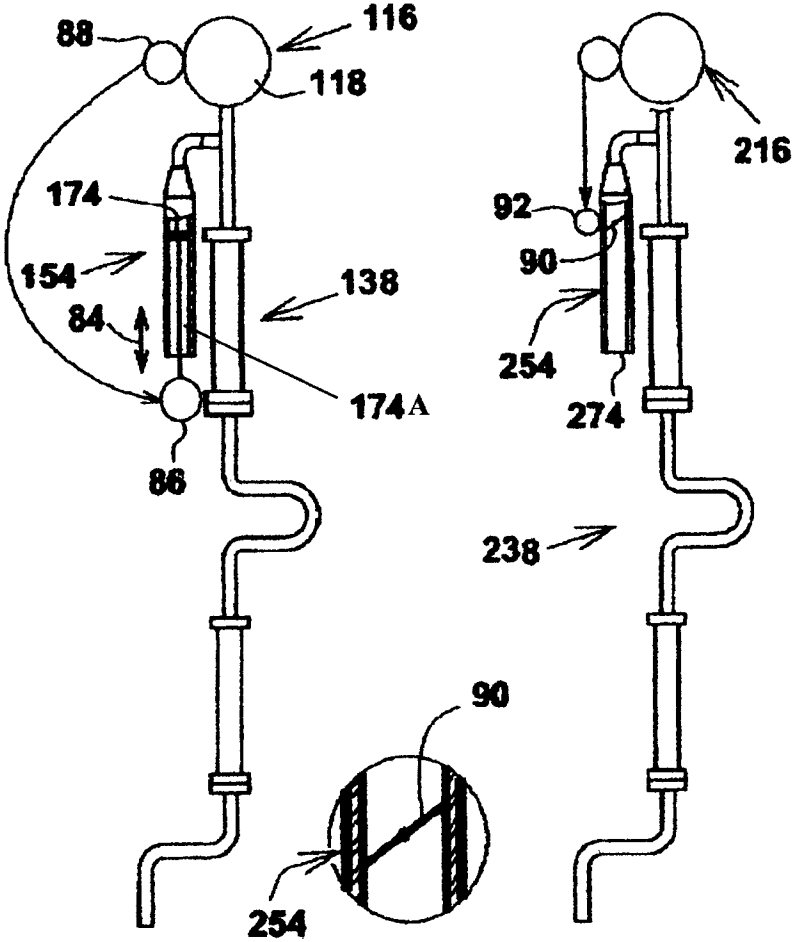
FIG. 5
FIG. 5A
FIG. 4
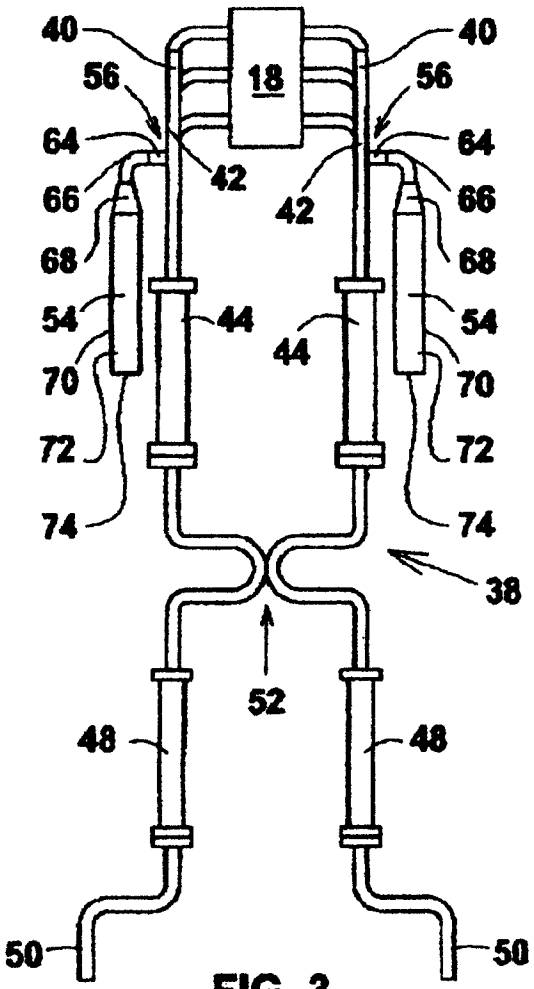
FIG. 3

IC POWER PLANT AND METHOD OF OPERATION

CROSS REFERENCE TO RELATED APPLICATIONS

This application is a Continuation-In-Part (CIP) of my pending U.S. application Ser. No. 13/459,849, filed 30 Apr. 2012, and of my application Ser. No. 12/455,704, filed 5 Jun. 2009, now abandoned, the disclosures of which are hereby incorporated into this present application by reference to the extent necessary for a full enabling disclosure of the invention.

BACKGROUND OF THE INVENTION

Field of the Invention

The present invention relates generally to an improved internal combustion (IC) power plant of the four-stroke, or four-cycle type. Four-stroke engines inherently have a pulsatile intake and exhaust flow, into and from the combustion chamber(s). The inventive IC power plant has an enhanced or improved pulsatile exhaust gas flow so that one or more advantages, such as: improved volumetric efficiency, improved fuel economy, improved torque and horsepower production (especially at low engine speeds), reduced catalytic converter size (i.e., for gasoline-fueled automotive engines), as well as other benefits are realized.

Related Technology

IC engines generally and historically have used one or more mufflers in order to both reduce the noise level of the engine exhaust and possibly to enhance pleasant frequencies or tones in the exhaust. The conventional mufflers and exhaust systems are also configured to control undesired resonance(s) or droning in the exhaust system, and to provide a desired level of quietness, or in some cases to provide a somewhat more noisy "performance" sound for an automobile for example. In the automotive context, exhaust systems are generally graded or ranked in comparison to the performance loss that they cause in comparison to an "open pipes" exhaust system, and in terms of the level of exhaust noise they inflict on passengers and on bystanders of the vehicle.

For some time intake and exhaust systems for IC engines (i.e., in passenger automobiles especially) have been known which include resonant or reactive chambers intended to reduce resonance or droning of the intake or exhaust system at particular engine speeds, or within particular engine speed ranges, so that passengers of the vehicle are not subjected to an undesirable noise, vibration, or harshness (i.e., "NVH" in common engineering terminology). These known resonant chambers for abatement of NVH are generally added to a vehicle solely in the interest of comfort and civility of the vehicle. A well-known example of the use of a resonant chamber to address a noise, vibration, or harshness (NVH) problem is presented in US patent publication No. 2006/000067 A1, dated 5 Jan. 2006, by Dale F. Osterkamp, et al. The Osterkamp publication is believed to disclose a sound dampening assembly, including a resonant chamber connected at a determined location along the length of an automotive exhaust system at an identified pressure anti-node (not at a velocity node) of the objectionable vibration (i.e., sound) it is wished to alleviate or eliminate. This anti-node is located by identifying the location along the length of the exhaust system where the objection vibration is most pronounced. No improvement in engine performance (i.e., torque or horse power output) or fuel economy is known to result from such a resonant chamber used to control NVH.

SUMMARY OF THE INVENTION

The improved IC power plant according to this invention may find application to, for example, stationary or portable electrical power generation; propulsion of aircraft, boats, or automobiles; operation of heavy trucks and construction equipment; water pumping; and a variety of other uses in which a 4-stroke cycle internal combustion engine is or can be used. More Particularly, this invention relates to such an improved IC power plant in which the exhaust system includes one or more reactive or resonant chambers. These resonant chambers may preferably be of the Helmholtz chamber configuration, or may be configured as ¼ wave chambers or pipes. These chambers are in exhaust gas flow communication with the IC engine as close as is practicable to the exhaust valves of the engine, so as to provide reaction to the exhaust pulsatile flow at the exhaust valve(s) and combustion chamber(s) of the engine. The exhaust valve(s) of a four-stroke IC engine provide velocity nodes for the flow of exhaust gases out of the engine cylinder(s), so that the gas velocity is zero when the exhaust valve(s) are closed. The reactive or resonant chamber(s) according to the present invention are placed in close gas flow communication with the velocity node(s). An improved volumetric efficiency for the IC engine (especially at low engine speeds) as well as other benefits result. For example, injection of sound energy from the Helmholtz chamber(s) into the combustion chambers of the engine via the exhaust valve(s)—when the exhaust valve is open—is believed to assist in vaporizing fuel droplets, and possibly to act as a form of beneficial turbulence in the combustion chambers, thus improving flame propagation and combustion efficiency of the engine. Another one of the additional benefits of this present invention is a reduction in peak exhaust gas flow velocity in the exhaust system at selected locations downstream of the exhaust valves of the engine, and a resultant increase in residence time for exhaust gasses in a catalytic converter (i.e., for a gasoline-fueled automotive engine, if so equipped) of the exhaust system. Increased residence time for exhaust gasses in a catalytic converter allows the use of a smaller converter with concomitant decrease in the use of precious metals (i.e., platinum, for example).

The Helmholtz or ¼ wave chamber(s) of the exhaust system according to the present invention may also be constructed with a variable geometry, or may include a valving device, so as to provide a variable-volume Helmholtz chamber, or variable-length of ¼ wave chamber or pipe. The Applicant has found that by selection of the proper volume, length, and location of the Helmholtz chamber(s) or ¼ wave chambers according to this invention relative to the exhaust valves (i.e., relative to the velocity node(s)) of an IC engine that enhanced pulsatile flow in the exhaust system will assist in both exhaust scavenging, and reduced loss of fresh charge from the combustion chambers of the engine. An improved power output for the engine, particularly improved torque and horse power production results.

In view of the deficiencies of the conventional related technology, it is an object of this invention to overcome or reduce one or more of these deficiencies.

Another objective for this invention is to improve the torque and horsepower production of a four-cycle automobile engine;

Still another objective for this invention is to allow the use of smaller catalytic converters on gasoline-fueled automobile engines;

An object for this invention is also to improve gasoline fuel efficiency for an automobile engine;

These and other objectives and resultant additional advantages may be realized by the present invention according to this disclosure.

Corporate Average Fuel Economy (CAFE)

An important consideration for the present invention is improvement of Corporate Average Fuel Economy (CAFE) figures, especially for automobiles and light trucks. CAFE requirements have historically been difficult for manufacturers to meet, and their failures to meet CAFE requirements has resulted in many automobile manufactures having to pay fines and other charges to various governments around the world. A major consideration in the efforts to meet CAFE requirements is the expectations and demands of consumers for a certain level of performance and drivability of new cars, versus the small size of conventional IC engines that would be necessary in order to successfully meet CAFE requirements. This present invention may well allow a much smaller engine to satisfy consumer's performance and drivability expectations, while also delivering much better fuel economy. This is the case because an IC power plant according to the present invention produces much better torque and horsepower than does a conventional normally-aspirated IC engine. Conventional technology would require the engine to be supercharged (i.e., turbo-super charged or supercharged by a mechanically driven blower or pump) in order to provide comparable torque. Without the need for such supercharging, the present invention provides a relatively small engine with good fuel economy, but with increased torque and horsepower, providing a driving experience comparable to a vehicle powered by a considerably larger—and less fuel efficient—conventional IC engine.

In view of the above, objects for this invention are to achieve one or more of: allowing engine downsizing while maintaining acceptable drivability (thereby indirectly increasing fuel efficiency), increasing exhaust volumetric efficiency for an IC engine, decreasing requirements for fuel enrichment, reducing IC engine internal frictions by providing an IC engine operating at lower RPM, directly increasing fuel efficiency for an IC engine.

Accordingly, one particularly preferred embodiment of the present invention provides an internal combustion (IC) power plant, the IC power plant having an IC engine including a variable-volume combustion chamber producing a flow of combustion gas products, an exhaust port flowing the combustion gas products from the IC engine, and an exhaust valve disposed at the exhaust port and when closed defining at the exhaust port a velocity node of zero velocity for the flow of combustion gas products; and a branched exhaust system conveying the combustion gas products from the exhaust port of the IC engine to atmosphere, the branched exhaust system including a first branch having a length of exhaust conduit at a first end receiving combustion gas products from the exhaust port, and the length of exhaust conduit terminating at a second end conveying the combustion gas products to atmosphere; a second branch of the exhaust system having a respective second length of exhaust conduit communicating with the first branch adjacent to the first end thereof, and receiving combustion gas products from the exhaust port, the second branch and the respective second length of exhaust conduit dead-ending in a resonant chamber of selected resonant frequency; and the resonant chamber including structure selected from the group consisting of: a Helmholtz resonator chamber, and a ¼ wave resonant pipe; whereby the second branch of the exhaust system both receives combustion gas products from the exhaust port via the first branch, and returns combustion gas products to the first branch according to the selected resonant frequency.

Other objects, features, and advantages of the present invention will be apparent to those skilled in the art from a consideration of the following detailed description of a preferred exemplary embodiment thereof taken in conjunction with the associated figures which will first be described briefly.

BRIEF DESCRIPTION OF THE DRAWING FIGURES

FIG. 1 provides a schematic and illustrative view of an automotive vehicle equipped with an internal combustion engine and exhaust system embodying the present invention;

FIG. 1A provides a diagrammatic view of one bank of the internal combustion engine seen in FIG. 1;

Figure 1:
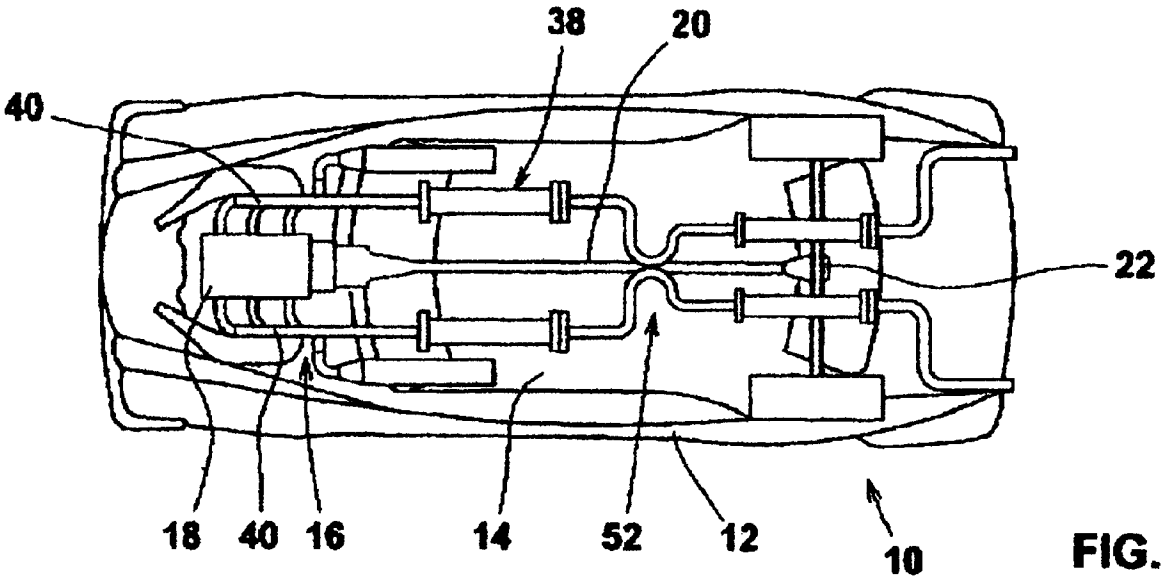
FIG. 1B is a diagrammatic illustration of a simplified exhaust system, and of gas velocity for combustion products flowing along this exhaust system toward an outlet versus position along the length of the simplified exhaust system.
Figure 2:
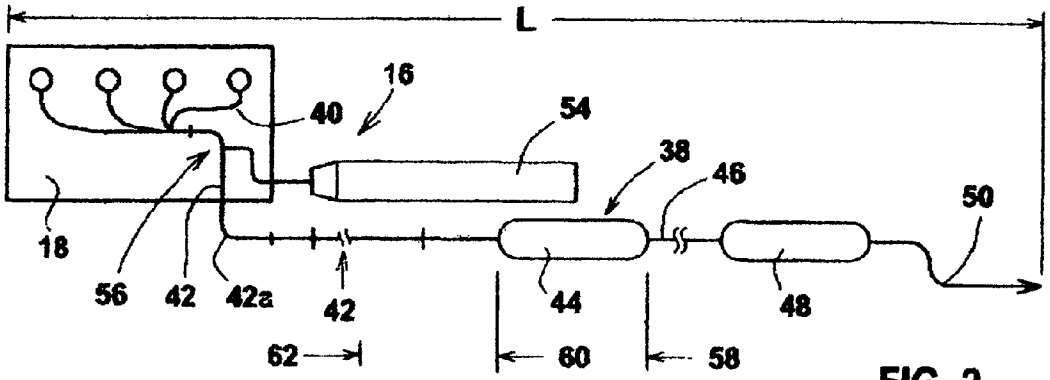
FIG. 2 is a schematic perspective view, partially in phantom lines, of the internal combustion engine and exhaust system according to this invention as seen in FIG. 1.
Figure 6:
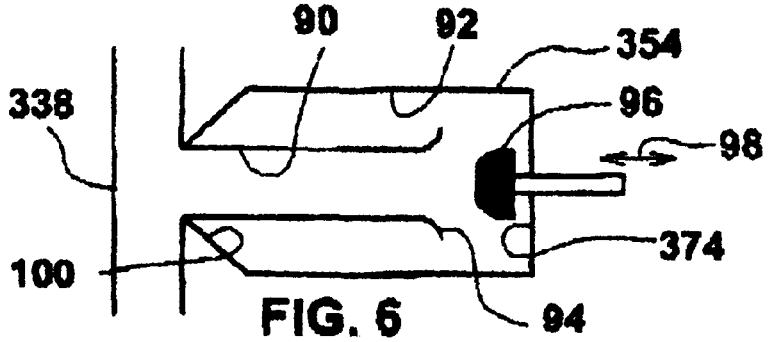
Figure 7:
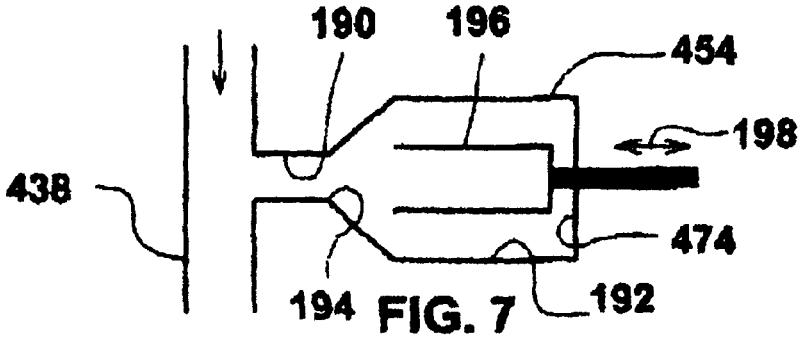
Figure 7A:
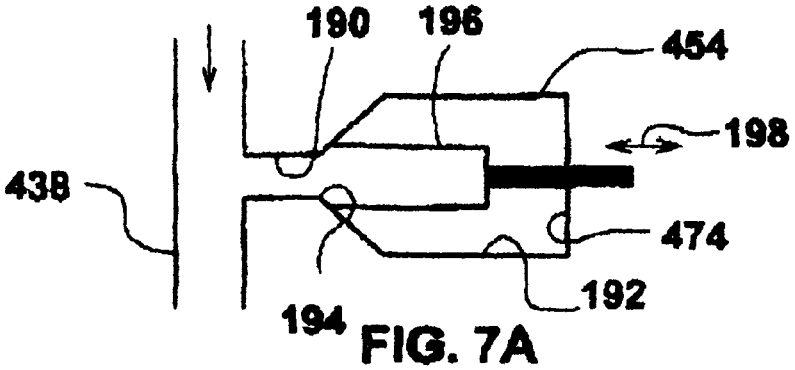
Figure 8:
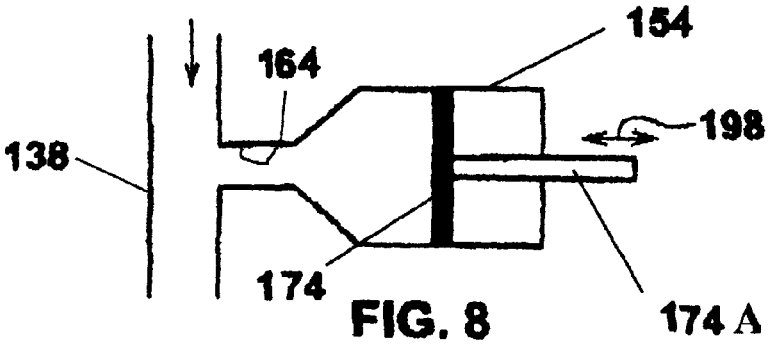
Figure 9:
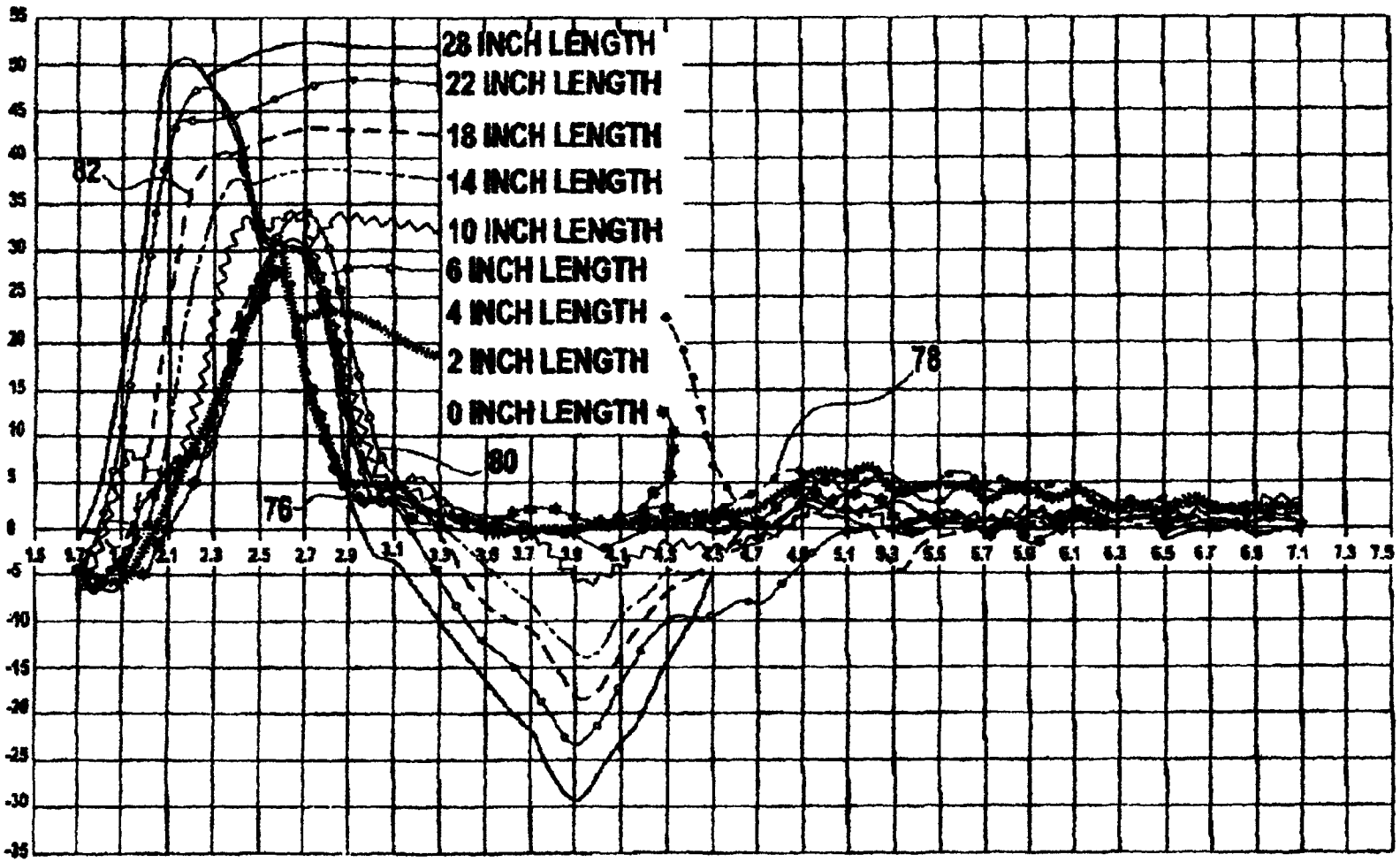
Figure 10:
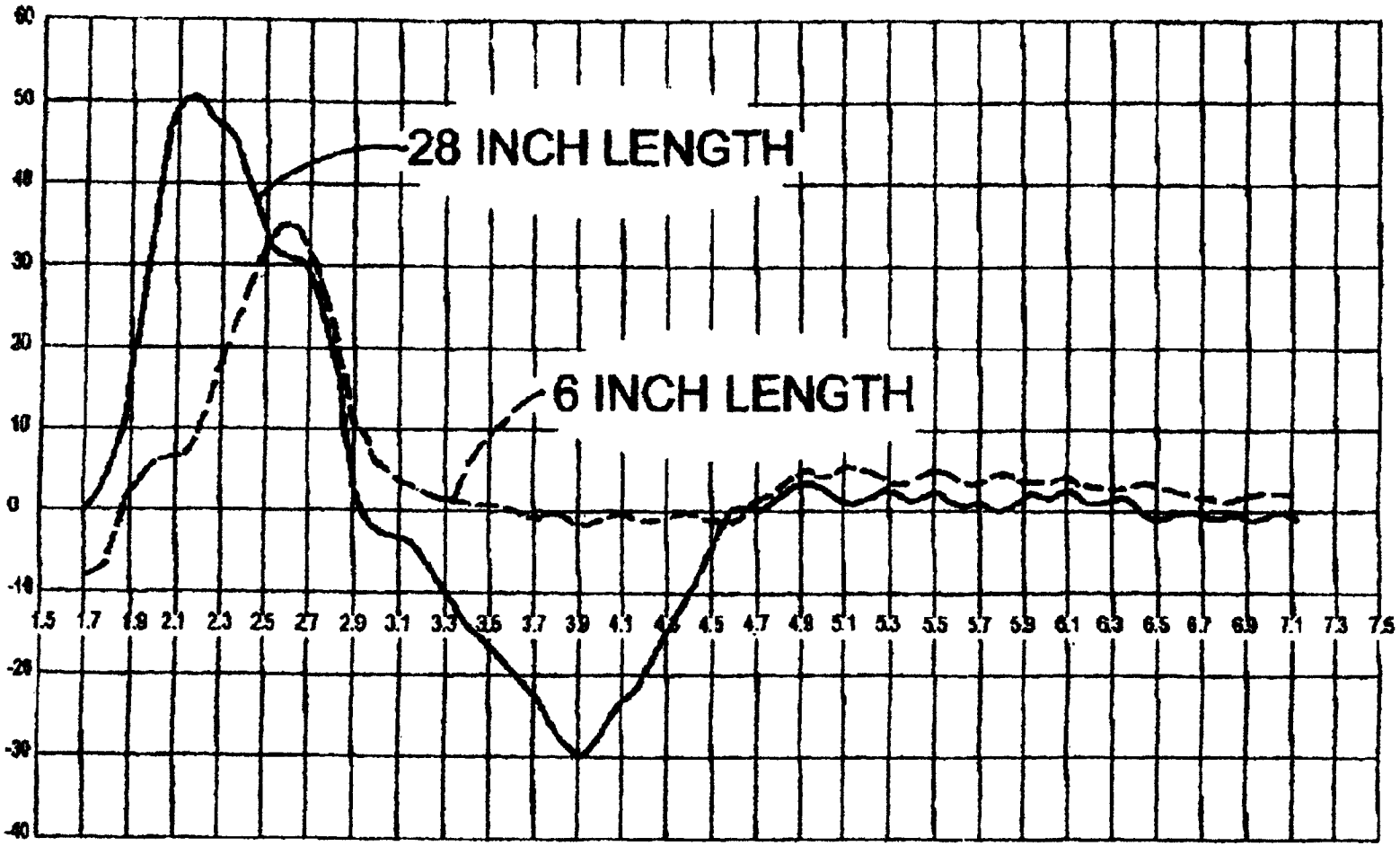

FIG. 3 provides a diagrammatic plan view of the automotive vehicle seen in FIGS. 1 and 2, and illustrates particularly a pair of Helmholtz chambers which form a part of the system combining the internal combustion engine and exhaust system;

FIG. 4 provides a diagrammatic plan view of an automotive vehicle similar to that seen in FIGS. 1-3, and illustrates particularly a pair of variable length Helmholtz chambers which form a part of the system combining the internal combustion engine and exhaust system;

FIG. 5 provides a diagrammatic plan view of an automotive vehicle similar to that seen in FIGS. 1-3, and similar to that of FIG. 4, and illustrates particularly a pair of variable geometry, valved, dual-length Helmholtz chambers which form a part of the system combining the internal combustion engine and exhaust system;

FIG. 5A illustrates a valving portion of one of the Helmholtz chambers seen in FIG. 5 in which a valve portion of the Helmholtz chamber is closed in order to provide a chamber of shorter length;

FIG. 6 illustrates a portion of an exhaust system of an IC power plant including a folded coaxial Helmholtz chamber which is valved to provide dual lengths;

FIGS. 7 and 7A illustrate a portion of another embodiment of an exhaust system of an IC power plant, in which an Helmholtz chamber includes features of a Helmholtz chamber and of a ¼ wave or ½ wave chamber, with an actuator for changing the Helmholtz chamber respectively from one configuration to the other as is illustrated in these two drawing Figures;

FIG. 8 illustrates a portion of yet another embodiment of an exhaust system of an IC power plant, in which an Helmholtz chamber also has features of a Helmholtz chamber and also has variable geometry effected by an actuator and movable wall portion to provide a continuously variable length for the Helmholtz chamber;

FIG. 9 is a graph of torque versus engine speed for several actual tests on a dynamometer of an IC power plant embodying this invention; and FIG. 10 is a graph of a torque versus engine speed for another embodiment of the present invention actually tested on a dynamometer.

DETAILED DESCRIPTION OF EXEMPLARY PREFERRED EMBODIMENTS OF THE INVENTION

While the present invention may be embodied in many different forms, disclosed herein are several specific exemplary embodiments which illustrate and explain the principles of the invention. In conjunction with the description of these embodiments, a method of providing and operating an internal combustion power plant according to this invention will be apparent. It should be emphasized that the present invention is not limited to the specific embodiments illustrated.

FIG. 1 diagrammatically illustrates an automotive vehicle 10 having a chassis and body, generally indicated collectively with the numeral 12. The chassis/body 12 define therein a passenger compartment, which is generally indicated with the numeral 14. The vehicle 10 in this instance is seen to be of front-engine design, with rear wheel drive, although the invention is not so limited. Importantly, the automotive vehicle 10 includes a power plant, which is generally indicated with the numeral 16. This power plant 16 includes an internal combustion (IC) engine 18, a transmission and drive shaft combination, indicated with the numeral 20, and a rear axle 22.

Viewing FIG. 1A, it is diagrammatically illustrated (and is further explained below), that the IC engine 18 thus includes an intake port 24 leading to an intake valve 26, and communicating to a combustion chamber 28. The combustion chamber 28 similarly communicates with ambient via an exhaust valve 30 controlling flow of combustion products to an exhaust port 32. The exhaust port has an opening 18*a* on the engine 18. A piston 34 reciprocates in a bore 36 (i.e., cylinder) of the engine 18 and forms a part of (or communicates with) the combustion chamber 28, so that the combustion chamber has or communicates with a variable-volume in response to reciprocation of the piston 34. As will be familiar to those ordinarily skilled in the pertinent arts, the piston 34 makes four (4) strokes along the length of the bore 36 in order to complete one power-producing cycle for the engine 18. The engine 18 may have plural such cylinders, pistons, and exhaust ports, as is well understood in the pertinent art.

Figure 1A:
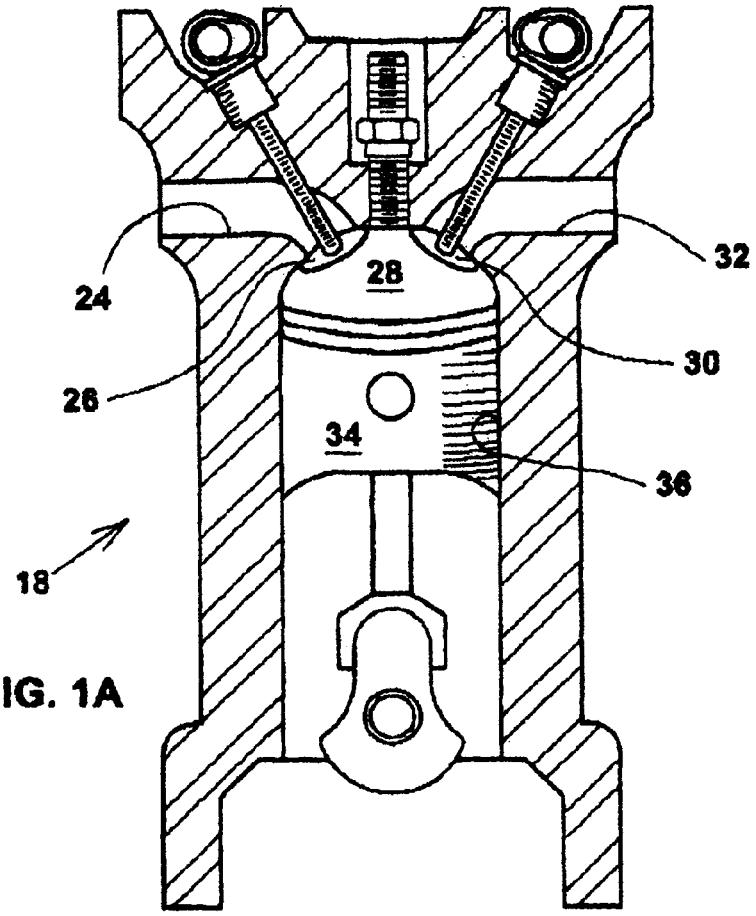

Considering FIGS. 1, 1A, and 2 in conjunction with one another, it is seen that the power plant 16 includes an exhaust system, generally indicated with the numeral 38. As will be further explained, the exhaust system 38 has a first end at its communication with the engine 18, and a second end where it opens to atmosphere in order to communicate combustion gas products to the atmosphere. This exhaust system includes a pair of exhaust manifolds 40 each mounted to the engine in communication with the exhaust ports of respective cylinders of the engine. Each exhaust manifold 40 communicates with a respective first section 42 of exhaust pipe extending downwardly and rearwardly along the vehicle 10. Thus, the pipe section 42 is commonly referred to as a down pipe. At the aft ends of each of the respective sections 42 of exhaust pipe are located one of a pair of catalytic converters 44, each communicating with a respective second section of exhaust pipe 46. These second sections of exhaust pipe 46 in turn each communicates with a respective second muffler 48, and hence to a respective tail pipe 50. Conventionally, the pair of exhaust pipes 42 are interconnected by a cross-over 52, which in this case has an X-configuration (best seen in FIG. 1). It will be understood that the details of the embodiment of power plant depicted and described by reference to FIGS. 1, 1A, and 2 are exemplary and that the invention is not limited to these precise details.

Figure 1B:
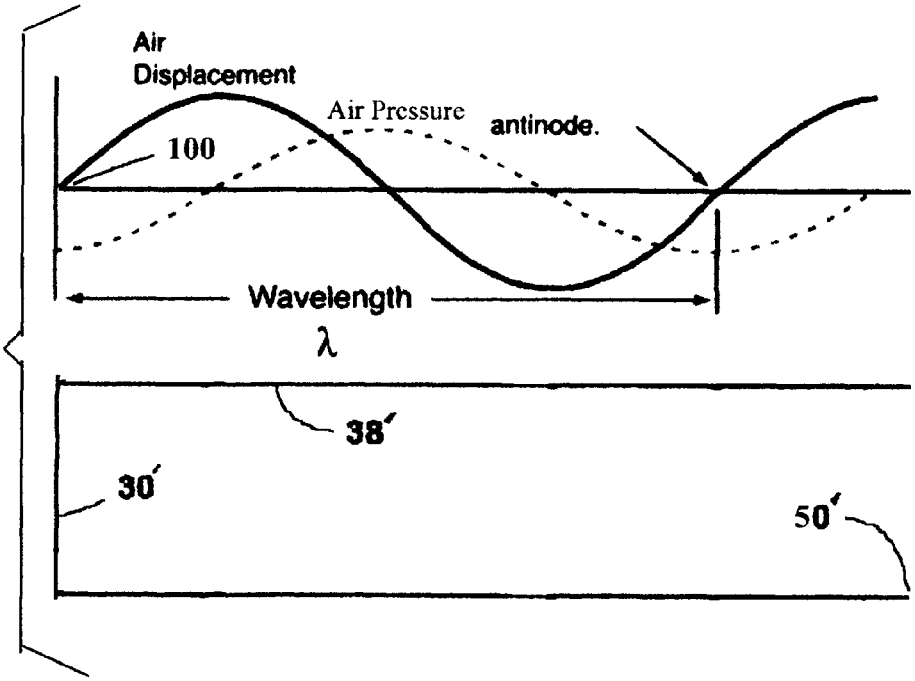

Considering now FIGS. 1B and 2 in conjunction with one another, it is to be noted that with respect to the combustion chamber 26 and exhaust system 38, the exhaust valve 30 when closed necessarily establishes a primary velocity node. Those ordinarily skilled in the pertinent arts will understand that this is the case because the closed exhaust valve dictates that gas velocity at the valve 30 be zero. By way of analogy, in FIG. 1B a closed-ended pipe 38' closed at one end by a wall 30 represents the exhaust system 38 with exhaust valve 30 in its closed position. The opposite end of the pipe 38' is open as is indicated by numeral 50' indicating this open end is analogous to the tail pipe portion of the exhaust system 38, and its opening and communication of combustion product gasses to atmosphere. FIG. 1B also includes a diagram of velocity and displacement along the exhaust system 38 (represented by the analogous pipe 38') with a velocity node 100 at the closed exhaust valve (represented analogously by end wall 30') and a velocity anti-node at the open end 50' of the pipe 38'. Similarly, there is a pressure anti-node at the closed valve 30, and a pressure node (essentially atmospheric pressure) at the open end 50' of the pipe 30' Further, there inherently will be other velocity and pressure nodes and anti-nodes in the exhaust system 38, as can be appreciated from the well-understood technology.

To this point in the disclosure of the exhaust system 38 of the power plant 16, all of the components are conventional and are well-known. However, returning to a consideration of FIGS. 1 and 2, and also considering FIG. 3, it is seen that the exhaust system 38 of power plant 16 includes a pair of Helmholtz chambers (or reactive sound reflecting chambers, or tuned chambers, which may be configured advantageously as ¼ wave pipe) 54, each connecting to a respective one of the exhaust pipes 42, or to the exhaust manifolds 40 preferably as close as is practicable to the exhaust valves 30 of the engine 18 (i.e., as close as is practicable to the primary velocity node established by the exhaust valve 30 when closed). In other words, the exhaust system 38 defines a branching at 56, which preferably would be immediately at (i.e., immediately outside of) the exhaust port 32 of the engine 18, recalling FIG. 1A. The illustrations of FIGS. 1 and 2 recognize the practicalities of applying the present invention to existing engine designs and existing vehicles, which will not currently allow the branching 56 of the exhaust system to be right at the exhaust valve 30 or immediately outside of exhaust port 32. In this embodiment, the Helmholtz chambers 54 each connect in flow communication with the exhaust ports and combustion chambers of the engine 18 at a location indicated with the arrowed numeral 56, which is preferably at the first end of the exhaust system 38, as close to the exhaust valve 30 as possible.

Moreover, viewing FIG. 2 particularly, the exhaust system 38 has a length "L" extending from the exhaust valves and exhaust ports of the engine 18 rearwardly of the vehicle 10 along a flow path defined in combination by the exhaust manifolds 40, exhaust pipes 42 and 46, and mufflers 44 and 48, leading to the tail pipes 50. As is seen in FIG. 2, the first section of exhaust pipe 42 includes a serpentine down tube section 42*a*. This down tube section extends only a little way along the length of the vehicle 10 but adds length to the exhaust system 38 because of its downward extent. The cross-over 52 does not significantly change the length of this exhaust system 38, but merely serves to balance pressures and flows on the opposites sides of the illustrated dual exhaust system.

However, in view of the above and the recognized practicalities and limitations of applying this present invention to existing engines and vehicles, it is to be noted that the connection (branching) location 56 is well forward (i.e., closer to the exhaust valves and exhaust ports of engine 18) of a point 58, which point indicates on the illustration of FIG. 2 the mid-length point of the exhaust system 38. More preferably, the point 56 is located forward of a point 60, which indicates the ⅓ length point of the exhaust system 38. And, most preferably, the point 56 is located forward of a point indicated with the numeral 62, which indicates the ¼length point of the exhaust system 38. The point at which the point of connection 56 for the Helmholtz chambers 54 can be located will in many cases have to be selected in view of design criteria having to do with the overall design of the vehicle 10, with the size and location of its passenger compartment, its engine, and many other design criteria beyond the scope of this discussion. However, it is desired to have the Helmholtz chambers communicate with the remainder of the exhaust system as close as is practicable to the exhaust valves and exhaust ports of the engine 18, as has been explained above. The invention is not intended to be limited by the present illustrations nor by the inherent limitations of present engines and vehicles.

Turning now to particular consideration of FIG. 3, it is seen that the Helmholtz chambers 54 each have a neck portion or nipple 64 communicating with a respective one of the exhaust pipes 42 (i.e., in the form of a T-connection, although the invention is not so limited), and an elbow section 66 of pipe communicating between the nipple 64 and a divergent or cone shaped section 68. The cone shaped section communicates with a length of tubing 70 which internally defines the main volume 70 for the Helmholtz resonator chamber 54. The branch of the exhaust system 38 including the Helmholtz chamber 54 inherently has a respective length. The Helmholtz chambers 54 are dead-ended at a wall 74, although the invention is not so limited.

Also, a particular range of volumes for the Helmholtz chamber volume 72 of each of the Helmholtz chambers 54 is expected to provide the best results for this invention, although testing has shown that a considerable range of volumes can be employed and still enjoy the benefits of this present invention. Particularly, it is believed that a volume for the Helmholtz chamber of from about 1/10 to 4 times the displacement volume of the engine will give an effective embodiment of the present invention.

Considering now the graph of FIG. 9, the results of testing involving the installation of a test apparatus version exhaust system embodying the present invention onto an otherwise stock automobile having a 3.5 liter engine (i.e., with no other modifications) is shown. Installation of the inventive exhaust system converted the stock IC engine of the test automobile (in combination with the inventive exhaust system) into an IC power plant according to this invention. The inventive exhaust system was configured for purposes of this test so that the effective volume of the Helmholtz chambers could be manually varied between tests (i.e., by moving an analog of the wall 74 sealingly along the length of an elongate Helmholtz chamber) in order to provide differing test conditions for the power plant. In other words, these Helmholtz chambers were test articles, allowing the dead-end wall of the Helmholtz chambers to be manually moved between tests. In order to assure a high degree of accuracy and repeatability for testing of embodiments of the present invention, the Applicant utilized a well-know and well respected chassis dynamometer. This graph of FIG. 9 is normalized along the horizontal axis to the stock torque output of the engine, so that the stock output appears along the horizontal zero (0) line of the graph. On the vertical scale of this graph, the torque values are shown as percentages of increase (or decrease) in comparison to the stock torque produced by the engine at a particular speed.

Considering first the line 76 of FIG. 9, it is seen that an Helmholtz chamber of 2 inches length produced a considerable torque increase extending over a speed range from about 2000 RPM to about 3100 RPM, which reached a peak at of about 15 percent increase at about 2600 RPM. A further more modest torque increase extended from about 4000 RPM all the way to the RPM limit of the engine at 7100 RPM. It is to be noted that the connection point for the Helmholtz chamber in this and the following tests was within three feet of the exhaust ports along the length of the exhaust system. Preferably, this connection point is at the exhaust ports, or within three feet of length along the exhaust system. However, a more distant connection point (i.e., branching of the exhaust system 38) for the Helmholtz chamber may be utilized, as is described herein.

However, as is shown by line 78 of FIG. 9, an Helmholtz chamber of 4 inches length produced about the same low speed torque increase extending over a speed range from about 2000 RPM to about 3100 RPM, which also reached a peak at of about 15 percent increase at about 2600 RPM. This slightly longer Helmholtz chamber length provided a slightly greater torque increase than did the 2 inch chamber, extending from about 4000 RPM all the way to the RPM limit of the engine at 7100 RPM.

Similarly, the line 80 of FIG. 9, shows that an Helmholtz chamber of 6 inches length produced a torque increase extending over a speed range from about 1800 RPM to about 3700 RPM, which reached a peak at about 18 percent at about 2600 RPM. However, for the first time with this length of Helmholtz chamber, we seen a torque decrease at about 3900 RPM. This same 6 inch Helmholtz chamber length produced a substantial torque increase beginning at about 4700 RPM, and extending to the RPM limit of the engine.

However, the line 82 of FIG. 9 shows the testing results for an Helmholtz chamber of 18 inches length, which produced a torque increase extending over a speed range from about 1900 RPM to about 3300 RPM, which reached a peak at about 19 percent at about 2400 RPM. However, this 18 inch Helmholtz chamber also caused a substantial torque decrease of about 15 percent at about 3900 RPM, and another smaller torque dip at about 5300 RPM. Although there was a region of torque gain in between these two torque dips, the torque gain out to the RPM limit of the engine was not as substantial as other lengths of Helmholtz chambers. However, this testing on this particular engine showed that the Helmholtz chamber of 18 inch length was alone in producing the sharp torque dip at about 5300 RPM.

Additional Helmholtz chambers of 10, 14, 22, and 28 inches (each with concomitant resonant frequencies) were configured using the test-article Helmholtz chambers (i.e., by manually moving the bluff dead-end wall of the test-article Helmholtz chambers) and tested on the same vehicle by the Applicant, with the results of these tests being shown also on FIG. 9. As can be seen in FIG. 9, the Helmholtz chambers of 22 and 28 inches length produced dramatic improvements in the low speed torque production of the engine, but also resulted in dramatic torque dips at about 3900 RPM. From this we can conclude that for IC power plants with engines operating at lower speeds, perhaps such as those used for water pumping, for electrical power generation, or for aircraft or boat propulsion, that an fixed-resonant-frequency Helmholtz chamber installation according to this invention could result in a substantial torque advantage.

However, moving on now to a consideration of FIG. 10, it is seen that for the same 3.5 liter engine, an Helmholtz chamber of 28 inches length produces the expected low RPM torque increase. However, in this case, careful selection of the volume and shape of the Helmholtz chamber has resulted in a torque increase not of the 20 to 22 percent experienced in the earlier testing, but of substantially 50 percent over the same engine in stock condition. Similarly, an Helmholtz chamber of 6 inches length produced in this instance a torque increase of about 35 percent. As is seen on FIG. 10, the torque increase lines cross in the RPM range from about 2500 RPM to about 2700 RPM. While the longer Helmholtz chamber produced the expected torque dip at higher RPM, this effect can be avoided by switching the longer Helmholtz chamber out within the speed range extending from about 2500 RPM to about 2700 RPM (i.e., the cross over range mentioned above), and inserting the shorter 6 inch Helmholtz chamber. However, physically removing one Helmholtz chamber and installing another on a running engine is not practicable. So, the Applicant has determined that a variable geometry or valved Helmholtz chamber (or Helmholtz chambers) offers substantially an optimum design for this particular test engine.

FIG. 4 illustrates an IC power plant 116 including an IC engine 118 and exhaust system 138 (both indicated schematically) embodying this present invention. It is seen in FIG. 4 that the Helmholtz chamber 154 has been constructed with a bluff dead-end wall 174 which is sealingly movable along the length of the chamber 154, rather like a piston moving along a bore, as is indicated by arrows 84. An actuator 86 is provided to move the wall 174 by means of a connecting rod 174A linearly along chamber 154 in response to an engine speed sensor and control circuit or device, indicated with numeral 88. In other words, the actuator 86 is a means for moving the wall 174, while the sensor and control circuit 88 is a means for detecting and taking action in response to the operational speed of the IC engine 118. Moreover, the sensor and controller circuit or device 88 is responsive to the speed of the IC engine 118 to move the wall 174 to optimum positions in view of the test data indicated in FIG. 9 by means of operation of the actuator 86 and connecting rod 174A. Thus, the IC power plant 116 provides a significant torque increase over substantially its entire speed range compared to a stock engine, and has no detrimental torque dips.

However, in view of the test results discussed above with reference to FIG. 10, it is seen that substantially all of the benefit of the present invention can be realized utilizing an embodiment that may be considerably simpler, perhaps more robust, and less expensive to implement. Considering now FIG. 5, it is seen that familiar reference numerals have been increased by 100 and indicate familiar structures or features. In FIG. 5, the Helmholtz chamber 254 has been constructed with a bluff dead-end wall 274 which is fixed in position, substantially at the 28 inch length seen indicated on FIG. 10. However, a valve 90, preferably of butterfly valve configuration, although the invention is not so limited, is disposed in the chamber 254 substantially at the location corresponding to a chamber length of about 6 inches. As FIG. 5A shows, while for lower speed operation of the engine 118, the valve 90 is maintained in an open position so that the bluff dead-end wall 274 is effective to establish the resonant frequency of the chamber 254, and to provide the torque increase indicated on FIG. 10 for speed below about 2500 RPM to about 2700 RPM, the valve 90 can be pivoted to the position seen in FIG. 5A for higher engine speeds.

A speed sensor and control circuit or device, indicated with numeral 188 is used to provide an output signal responsive to the speed of the IC engine 118 to dither the valve 90 between its opened and its closed positions in a bi-stable manner. In other words, at an engine speed of about 2500 RPM to about 2700 RPM with engine speed increasing, the valve 90 is dithered to a closed position. Conversely, at an engine speed of about 2500 RPM to about 2700 RPM with engine speed decreasing, the valve 90 is dithered to its opened position. A bi-stable actuator 92 is utilized to accomplish this dithering of the valve 90. With the valve 90 in its closed position, the butterfly valve plate of the valve serves as a dead-end wall, giving the Helmholtz chamber 254 an effective length of about 6 inches, and a concomitant resonant frequency. Accordingly, it is seen that the effective length (i.e., resonant frequency) of the Helmholtz chamber 254 is changed between two values or lengths in response to the speed of the IC engine 118 and in view of the test data indicated in FIG. 10. Thus, the IC power plant 116 associated with the Helmholtz chamber 254 provides a significant torque increase over substantially its entire speed range compared to a stock engine, and has no detrimental torque dips.

Turning now to FIG. 6, an alternative embodiment of the invention including an Helmholtz chamber is illustrated, with the Helmholtz chamber having characteristics of both a Helmholtz resonator and of a ¼ wave resonator. In FIG. 6 familiar reference numerals have been increased again by 100 and indicate familiar structures or features. In FIG. 6, the Helmholtz chamber 354 has been constructed with an inner connection passage 90 providing communication with the exhaust pipe 338. The inner connection passage extends within an outer generally concentric chamber 92, and has an open end 94. A plug valve member (i.e., of poppet valve type) 96 is movable, as is indicated by arrow 98, between a first position spaced from the open end 94 and adjacent to a first dead-end wall 374, and a second position in which the plug valve member 96 engages the adjacent end of the passage 90 and closes the open end 94. The arrow 98 also indicates a bi-stable actuator, similar to that already disclosed and described by reference to FIG. 5. Consequently, when the plug valve member 96 is in its second position, the Helmholtz chamber 354 has a comparatively short length, and the face of the plug valve 96 serves as a dead-end wall for the connection passage portion 90, effectively making this connection passage a ¼ wave resonant pipe. On the other hand, when the plug valve member 96 is moved to its second position, the dead-end wall 374 serves to define the volume of the Helmholtz chamber 354, and its resonant frequency.

FIG. 7 illustrates another alternative embodiment of the invention including an Helmholtz chamber structure which is converted to a ¼ wave pipe, in order to effectively provide two different resonant frequencies. In other words, this Helmholtz chamber structure may also be considered to have characteristics of both a Helmholtz resonator and of a ¼ wave resonator. In FIG. 7 familiar reference numerals have been increased again by 100 and indicate familiar structures or features. In FIG. 7, the Helmholtz chamber 454 has been constructed with a first connection passage 190 providing communication with the exhaust pipe 438. The connection passage extends to a larger generally concentric chamber 192, and has an opening at 194 to this larger chamber. A cup-shaped valve member 196 is movable, as is indicated by arrow 198, between a first position spaced from the opening 194 and adjacent to a bluff wall 474, and a second position in which the cup-shaped valve member 196 engages at its open end at the opening 194 of the connection passage 190 (as seen in FIG. 7A). In FIG. 7, the cup-shaped valve member is show at a position intermediate of its first and second positions for clarity of illustration. On the other hand, when the connection passage 190 is communicating at opening 194 with the larger chamber 192, then a dead-end surface or wall 474 of this larger chamber 192 is effective to provide a Helmholtz chamber 454 of comparatively low resonant frequency. And again, in this way when the cup-shaped valve member 196 is in its second position (FIG. 7A) a comparatively short ¼ wave resonant chamber is defined by the combination of the lengths of the connection passage 190 and the length of the cup-shaped valve member 196. Thus, a dual-frequency resonant structure can be provided in a compact structure possible of packaging with present engines and vehicles.

FIG. 8 illustrates a portion of yet another embodiment of an exhaust system of an IC power plant, in which an Helmholtz chamber also has features of a Helmholtz chamber and also has variable geometry effected by an actuator and movable wall portion to provide a continuously variable length and volume for the Helmholtz chamber. The embodiment of FIG. 8 is essentially the same at that shown in FIG. 4, but is presented diagrammatically, and perhaps better illustrates how a Helmholtz chamber may have characteristics of variable resonant frequency. Because FIG. 8 diagrammatically illustrates the embodiment of FIG. 4, the same reference numerals have been used on both.

Having observed the structure and function of an IC power plant according to this invention, including an IC engine, attention may now be directed to uses of this power plant to significantly improve the possible trade offs in performance, fuel economy, and reduced air pollution of automobiles, including a reduction in the use of precious metals, such as platinum utilized in catalytic converters. As a first consideration, it has been explained above that the torque and horsepower of an IC power plant according to this invention is remarkably improved. Thus, an automobile using a smaller IC engine according to this invention can provide substantially the same driving experience, and so will be accepted by consumers. And, the smaller engine will use less fuel, produce less air pollution, and have a smaller carbon footprint. Further, because the present invention lowers the peak exhaust gas flow through a catalytic converter, and increases the effective residence time for exhaust gasses in that catalytic converter, a smaller converter using less precious and expensive metals can be utilized further lowering the cost of the vehicle. It follows from the smaller size of the converter that a smaller catalytic converter will heat up more quickly from cold to its necessary catalyzing temperature, thus meaning that the automobile will emit less unburned hydrocarbons into the atmosphere, and will pollute less each time it is started from cold. Further, it is believed that this invention has applicability to turbocharged engines as well, with the Helmholtz chamber(s) connecting between the exhaust ports of the engine and the turbocharger. Thus, a turbocharged engine may enjoy an increase in cylinder scavenging, a reduction in peak exhaust flow back pressure because of the accumulator effect of the Helmholtz chamber(s) communicating with the exhaust ports, as well as possibly an improvement in turbocharger efficiency because of the turbocharger receiving a more uniform exhaust gas flow (i.e., similarly to the smoothing of exhaust gas flow that occurs at a catalytic converter.

Those skilled in the pertinent arts will further appreciate that the present invention may be embodied in other specific forms without departing from the spirit or central attributes thereof. For example, it is apparent that the dead-end wall (i.e., wall 74, for example) need not be bluff. A Helmholtz resonant chamber need not have a reflective dead-end wall. Further, a variation of an effective Helmholtz chamber may comprise the inclusion of absorptive material within the Helmholtz chamber, which it is believed will have the effect of lowering the resonant frequency of the Helmholtz chamber. As discussed above, the closed exhaust valve(s) of the IC engine establish a primary velocity node at the location of the exhaust valve(s), and with the present inventive exhaust system the pulsatile nature of the exhaust flow can be mitigated at downstream locations (i.e., providing an advantage in reducing the size and cost of a catalytic converter, for example). But, with an inventive exhaust system according to this invention, the resonant frequency of the resonant chamber also establishes a virtual velocity node (i.e., analogous to the closed end of a ¼ wave pipe), and allows the selective identification of both velocity and pressure nodes and anti-nodes along the length of the exhaust system (i.e., like exhaust system 38), measuring off wavelengths of selected frequencies along the length of the exhaust system. As discussed, a catalytic converter in the exhaust system according to the present invention may benefit from a maximizing of the exhaust gas residence time in the converter (i.e., because of mitigated pulsations of the exhaust gas flow, and reduced peak exhaust flow velocity at the catalytic converter), and can allow a smaller, lighter and less expensive converter to be utilized with satisfactory results. Those ordinarily skilled in the pertinent arts will realize that in a conventional exhaust system a catalytic converter is commonly exposed to pulsating exhaust flow, with the peak flow velocity of the pulses causing exhaust gasses to move through the converter so quickly and with such a short residence time in contact with the reactive elements of the converter that at least some essentially raw exhaust gasses exit the converter. The longer residence time at a catalytic converter afforded for gasses in an exhaust system according to this invention allows better exhaust gas treatment, and the use of a smaller, lighter, and less expensive catalytic converter. Further, and on the other hand, when the exhaust valves are open (fully or partially, then the volume of the combustion chamber is in gas flow communication with the volume of the resonant chamber, and it is believed these two chambers (i.e., combustion chamber and resonant chamber—chamber 54) resonate with one another; providing the advantages in torque production, volumetric efficiency, fuel atomization, combustion chamber turbulence, and over-all drivability (i.e., driver satisfaction) discussed above.

Because the foregoing description of the present invention discloses only particularly preferred exemplary embodiments of the invention, it is to be understood that other variations are recognized as being within the scope of the present invention. Accordingly, the present invention is not limited to the particular embodiments which have been described in detail herein. Rather, reference should be made to the appended claims to define the scope and content of the present invention.

I claim:

1. An internal combustion (IC) power plant, said IC power plant comprising:

an IC engine having a variable-volume combustion chamber producing a flow of combustion gas products, an exhaust port flowing said combustion gas products from said IC engine, and an exhaust valve disposed at said exhaust port and when closed defining at said exhaust port a velocity node of zero velocity for said flow of combustion gas products; and a branched exhaust system conveying said combustion gas products from said exhaust port of said IC engine to atmosphere, said branched exhaust system including a first branch having a length of exhaust conduit at a first end receiving combustion gas products from said exhaust port, and said length of exhaust conduit terminating at a second end conveying said combustion gas products to atmosphere;

a second branch of said exhaust system having a respective second length of exhaust conduit communicating with said first branch adjacent to said first end thereof, and receiving combustion gas products from said exhaust port, said second branch and said respective second length of exhaust conduit dead-ending in a resonant chamber of selected resonant frequency;

whereby said second branch of said exhaust system both receives combustion gas products from said exhaust port via said first branch, and returns combustion gas products to said first branch according to said selected resonant frequency;

wherein said resonant chamber structure is a Helmholtz resonator chamber, said Helmholtz resonator chamber including a neck portion communicating between said second length of exhaust conduit and a voluminous chamber portion of said Helmholtz resonator chamber, said voluminous chamber portion defining both a length dimension and a selected volume;

wherein said Helmholtz resonant chamber further includes a movable actuator along said length dimension of said Helmholtz resonant chamber, whereby movement of said movable actuator toward said neck portion effects an increase in the selected resonant frequency of said Helmholtz resonant chamber; and wherein said actuator is configured to include a poppet valve member sealingly engagable with said neck portion to effectively cut off communication of said selected volume of said Helmholtz resonant chamber with said neck portion thereof, whereby engagement of said poppet valve member of said movable actuator with said neck portion converts said neck portion effectively into a ¼ wave resonate pipe.

2. The IC power plant of claim 1 wherein said first branch further includes a catalytic converter.

3. The IC power plant of claim 2 wherein said catalytic converter is located along said first branch at the location of a second velocity node.

4. The IC power plant of claim 1 wherein said first branch includes a muffler.

5. The IC power plant of claim 1 wherein said IC engine defines an engine displacement volume, and said resonant chamber is selected to be of Helmholtz resonator chamber configuration, said Helmholtz resonant chamber defining a volume of from about $1/10^{th}$ to substantially 4 times the engine displacement volume of said IC engine.

6. An improved exhaust pipe structure for an internal combustion (IC) power plant including an IC engine having a variable-volume combustion chamber producing a flow of combustion gas products, an exhaust port flowing said combustion gas products from said IC engine, and an exhaust valve disposed at said exhaust port and when closed defining at said exhaust port a velocity node of zero velocity for said flow of combustion gas products; said improved exhaust pipe structure comprising:

a branched exhaust pipe structure for connection to said exhaust port of said IC engine and for conveying said combustion gas products from said exhaust port to atmosphere, said branched exhaust pipe structure including a first branch having a length of exhaust conduit at a first end receiving combustion gas products from said exhaust port, and said length of exhaust conduit terminating at a second end conveying said combustion gas products to atmosphere;

a second branch of said exhaust system having a respective second length of exhaust conduit communicating with said first branch adjacent to said first end thereof, and receiving combustion gas products from said exhaust port, said second branch and said respective second length of exhaust conduit dead-ending in a resonant chamber of selected resonant frequency;

whereby said second branch of said exhaust system both receives combustion gas products from said exhaust port via said first branch, and returns combustion gas products to said first branch according to said selected resonant frequency;

wherein said resonant chamber structure is a Helmholtz resonator chamber, said Helmholtz resonator chamber including a neck portion communicating between said second length of exhaust conduit and a voluminous chamber portion of said Helmholtz resonator chamber, said voluminous chamber portion defining both a length dimension and a selected volume;

wherein said Helmholtz resonant chamber further includes a movable actuator along said length dimension of said Helmholtz resonant chamber, whereby movement of said movable actuator toward said neck portion effects an increase in the selected resonant frequency of said Helmholtz resonant chamber; and wherein said movable actuator is configured to include a poppet valve member sealingly engagable with said neck portion to effectively cut off communication of said selected volume of said Helmholtz resonant chamber with said neck portion thereof, whereby engagement of said poppet valve member of said movable actuator with said neck portion converts said neck portion effectively into a ¼ wave resonate pipe.

7. The improved exhaust pipe structure of claim 6 wherein said first branch further includes a catalytic converter.

8. The improved exhaust pipe structure of claim 7 wherein said catalytic converter is located along said first branch at the location of a second velocity node.

9. The improved exhaust pipe structure of claim 6 wherein said first branch includes a muffler.

10. A method of operating an internal combustion (IC) power plant, said method comprising steps of:

providing an IC engine having a variable-volume combustion chamber producing a flow of combustion gas products, an exhaust port flowing said combustion gas products from said IC engine, and an exhaust valve disposed at said exhaust port and when closed defining at said exhaust port a velocity node of zero velocity for said flow of combustion gas products; and providing a branched exhaust system conveying said combustion gas products from said exhaust port of said IC engine along a first branch of said branched exhaust system and to atmosphere, providing said branched exhaust system with a first branch having a length of exhaust conduit at a first end receiving combustion gas products from said exhaust port, and said length of exhaust conduit terminating at a second end conveying said combustion gas products to atmosphere;

providing a second branch of said exhaust system having a respective second length of exhaust conduit communicating with said first branch adjacent to said first end thereof, and receiving combustion gas products from said exhaust port, providing for said second branch and said respective second length of exhaust conduit to dead-end in a resonant chamber of selected resonant frequency;

selecting said resonant chamber structure to include a Helmholtz resonator chamber, configuring said Helmholtz resonator chamber to include a neck portion communicating between said second length of exhaust conduit and a voluminous chamber portion of said Helmholtz resonator chamber, and configuring said voluminous chamber portion to define both a length dimension and a selected volume;

providing said Helmholtz resonant chamber with a movable actuator along said length dimension of said Helmholtz resonant chamber, whereby movement of said movable actuator toward said neck portion effects an increase in the selected resonant frequency of said Helmholtz resonant chamber; and providing said movable actuator with a poppet valve member sealingly engagable with said neck portion to effectively cut off communication of said selected volume of said Helmholtz resonant chamber with said neck portion thereof, whereby engagement of said poppet valve member of said movable actuator with said neck portion converts said neck portion effectively into a ¼ wave resonate pipe.

11. The method of claim 10 further including the step of including a catalytic converter in said first branch.

12. The method of claim 11 including the step of locating said catalytic converter at the location of a second velocity node.

13. The method of claim 10 further including the step of including a muffler in said first branch.

* * * * *